US007564438B2

(12) United States Patent
Kao et al.

(10) Patent No.: US 7,564,438 B2
(45) Date of Patent: Jul. 21, 2009

(54) METHOD TO AUTOMATICALLY REGULATE BRIGHTNESS OF LIQUID CRYSTAL DISPLAYS

(75) Inventors: Hsu-Pin Kao, Chang Hua Hsien (TW); Tsan-Hung Tsai, Sanchong (TW); Yi-Chia Shan, Jhongli (TW); Hsu-Chia Kao, Pingjhen (TW)

(73) Assignee: Marketech International Corp., Taipei (TW)

( * ) Notice: Subject to any disclaimer, the term of this patent is extended or adjusted under 35 U.S.C. 154(b) by 616 days.

(21) Appl. No.: 11/387,639

(22) Filed: Mar. 24, 2006

(65) Prior Publication Data

US 2007/0222730 A1 Sep. 27, 2007

(51) Int. Cl.
*G09G 3/36* (2006.01)

(52) U.S. Cl. ..... 345/89; 345/207; 345/690

(58) Field of Classification Search ..... 345/89, 345/690, 207

See application file for complete search history.

(56) References Cited

U.S. PATENT DOCUMENTS 7,050,074 B1 * 5/2006 Koyama ..... 345/690

7,446,779 B2 * 11/2008 Ikeda et al. ..... 345/589

* cited by examiner

*Primary Examiner*—Amare Mengistu
*Assistant Examiner*—Koosha Sharifi
(74) *Attorney, Agent, or Firm*—Egbert Law Offices PLLC

(57) ABSTRACT

The present invention provides a method to automatically regulate brightness of liquid crystal displays (LCDs), which resolves the overload and easy fatigue of human eyes and poor image contrast due to high brightness of the conventional LCD. The present invention includes use of four parts, including an image brightness regulating unit, an image brightness ratio computation and output controlling unit, an ambient light detection and brightness adaptation regulating unit and an image gray level expanding unit. The image signals of an LCD are processed in such a manner to enable automatic control of optical flux of LCD TV by regulating the gray level of output images. Also, optical flux of LCD TV can be automatically controlled with the change of images and ambient light, thus alleviating overburdening of human eyes and improving the contrast and comfort of images for a better visual effect.

8 Claims, 5 Drawing Sheets

METHOD TO AUTOMATICALLY REGULATE BRIGHTNESS OF LIQUID CRYSTAL DISPLAYS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an automatic brightness regulation method for a liquid crystal display (LCD). More particularly, the invention comprises an image brightness regulating unit, an image brightness ratio computing and output controlling unit and an ambient light detection and brightness adaptation regulating unit as well as an image gray level expanding unit.

BACKGROUND OF THE INVENTION

Flat panel displays are a future-oriented trend for the display industry. In particular, the liquid crystal display (LCD) attracts more attention thanks to its thin-profile, lightweight, lower radiation, lower power consumption and higher resolution and brightness. LCDs are now widely used in various applications from PCs, commercial display panels to home theaters.

The LCD is optimally suited for commercial display panels (rather than home theaters) thanks to its high brightness. This is owing to the fact that the brightness of an LCD is generated from backlit modules, which may change the light permeability by controlling the torsion of LCD, thus identifying the image brightness (gray level). If the images are displayed on an 8 bit LCD, the maximum brightness is observed at an image gray level of 255, or minimum brightness observed at image gray level of 0. At present, the brightness of an LCD TV is about 400 cd/m$^2$~600 cd/m$^2$ at a gray level of 255, or 0.5 cd/m$^2$~1.4 cd/m$^2$ at gray level of 0.

In order to adjust the quantity of light entering the human eyes, the pupil will zoom in/out, depending upon the strength of ambient light. When large-area high-gray level images (e.g. snow) are displayed on TV, the pupils of human eyes will zoom out to reduce the quantity of light entering the human eyes. When low-gray level night scenes are displayed in TV, the pupil will zoom in to increase the quantity of light entering the human eye. In practice, brightness or darkness of images varies alternatively, coupling with zoom in/out of pupil. Thus, a high-brightness LCD enables continuous zoom-in/out of a pupil, leading to easy fatigue of human eyes.

FIGS. 1 and 2 depict the relationship between brightness and brightness ratio of a CRT TV and an LCD TV. The optical flux of the TV is represented by the product of display ratio and brightness ratio. If the brightness ratio is observed to be more than a specified value, optical flux of the CRT TV is close to a steady state, so the variation of images will not lead to excess zoom-in/out of pupils and fatigue of eyes. To the contrary, optical flux of the LCD TV will vary markedly with the brightness ratio. If the images often vary within the range of brightness ratio, the pupil of human eyes will zoom in or out with the brightness ratio, leading to easy fatigue of the eyes.

As illustrated in FIG. 2, the LCD TV curves give a sense of poor image contrast, in addition to showing overload of human eyes after long-lasting TV enjoyment. This is because the pupil cannot provide real-time zoom in/out and timely adjustment. In the event of higher frequency of brightness and darkness, the human eyes cannot duly adjust the light quantity, thus leading to a sense of poor image contrast. For example, when two vehicles pass each other at night, the pupil will automatically zoom out due to high brightness of opposite lamps. After that, there will be an immediate sense of poor vision as the pupil is still in a zoom-out state. Moreover, normal vision can be restored after a period of time due to delayed response of the pupil to sharp changes in brightness.

Furthermore, the strength of ambient light has influence upon the comfort of the audience, especially for enjoying opera (e.g. Cat) that allows reduction in the brightness to create a suitable environment and better visual effect. With the decline of brightness of indoor light, the pupil will zoom in. If the brightness of the LCD TV is not properly reduced, the higher brightness of images will dazzle. So, the brightness of TV images must be properly regulated with the variation of ambient light for an optimum visual effect.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The features and the advantages of the present invention will be more readily understood upon a thoughtful deliberation of the following detailed description of a preferred embodiment of the present invention with reference to the accompanying drawings.

FIG. 3 shows a preferred embodiment of an automatic brightness regulation method for a LCD in the present invention. This method uses four parts, including: an image brightness regulating unit 10; image brightness ratio computing and output controlling unit 20; ambient light detection and brightness adaptation regulating unit 30; and image gray level expanding unit 40. Using these four parts, the images of the LCD are processed in such a manner to enable automatic control of optical flux of a LCD TV by controlling the gray level of output images.

The image brightness regulating unit 10 comprises a memory unit 11 and a multiplier 12. Based on ambient light and images, the unit 10 enables the gray level of output image to be regulated in such a manner so as to store the images in the memory unit. After completion of statistics of image brightness ratio and identification of brightness gains ($g_T$), the images in the memory unit are output with red, green and blue gray levels of the images being multiplied by corresponding brightness gains ($g_{TR}$, $g_{TG}$, $g_{TB}$), thereby regulating the image brightness by changing image gray level.

The image brightness ratio computing and output controlling unit 20 applies the images only for statistical analysis of image brightness, rather than calculation of output images. Thus, it is possible to considerably simplify the circuit structure without any influence of the details of the output image. For example, maximum 6-bit statistical brightness is enough to process 8-bit original image signal, thereby saving both hardware resources and circuit cost. The image brightness ratio computing and output controlling unit 20 comprises the following units:

a. A gray level/brightness converting unit 21 enables conversion between a gray level and corresponding brightness of image, as demonstrated by Gamma 0.45 curve of gray level (R', G', B') and brightness recorded by common image signals. Gamma 2.2 conversion shall be required for the gray level of images, such that a linearity between gray level (R'G' B) and brightness may help calculate the brightness of images.

b. A pixel brightness calculating unit 22 can convert red, green and blue gray levels (R, G, B) of pixels into brightness Y, with the conversion formula described below:

$$Y=0.3R+0.59G+0.11B$$

In another embodiment of the present invention for lightness calculation, the color space of perceptual uniformity is applied for lightness control. In 1976, a color space L*a*b* in compliance with perceptual uniformity was prepared by CIE. Given the fact of equal sense of lightness in L*a*b* color space, perceptual uniformity of L*a*b* color space can be applied to control the lightness of an LCD TV, showing a better perceptual sense than RGB color space. The lightness L* in L*a*b* is obtained from the following formula:

$$Y = (0.2126R + 0.7152G + 0.0722B)/255$$

$$L^* = \begin{cases} 930.3Y; & Y < 0.008856 \\ 116Y^{\frac{1}{3}} - 16; & 0.008856 < Y \end{cases}$$

The brightness statistics is performed by L* in lieu of Y.

c. A display brightness statistical unit 23 is used to calculate total brightness $Y_{image}$ and brightness ratio BR of every display. With the addition of the brightness of every point in the display, it is possible to obtain total brightness of this display. Then, the total brightness of the display is divided by maximum total brightness $Y_{total}$ of the image, thus obtaining its brightness ratio (BR). For a 8 bit image of N total pixels, the maximum total brightness $Y_{total}$ is:

$$Y_{total}=255N$$

Brightness ratio BR is obtained from the following formula:

$$BR = \frac{Y_{image}}{Y_{total}}/255 = \frac{Y_{image}}{N}$$

d. The brightness gains unit 24 comprises a brightness gains table. The corresponding brightness gains are checked using brightness ratio. This brightness gains table is a relational table of brightness gains $g_Y$ and brightness ratio established based on the relationship between expected brightness and brightness ratio.

e. A gains regulation determining unit 25 is used to calculate and regulate the change rate of brightness gain. The brightness gain output by the brightness gains unit will vary a lot with sharp change of brightness ratio. The brightness gains shall be output. The brightness gain will vary little with slow or minor change of brightness ratio (BR). The flickering of the image shall be avoided for smoothing the brightness gains.

When the brightness gain of neighboring image has a change rate lower than a threshold Th, the output brightness gain shall be a mean value of brightness gain output by K-1 images and current brightness gain, namely:

$$g_{y_{out}} = \frac{1}{K}\sum_{i=1}^{K} g_y$$

The ambient light detection and brightness adaptation regulating unit 30 has an optical sensor used to detect the change of ambient light. With a reference to LUT after low pass filtering (averaging) of the change of ambient light, it is possible to determine the brightness gain GA of ambient light. This sensor of ambient light is available in monocolor or multicolor type. For a multicolor light sensor, the gains $G_{AR}$, $G_{AG}$, $G_{AB}$ will be properly regulated with the color change of ambient light. When an opera film is enjoyed by the audience, an indoor fluorescence lamp of color temperature 7000K shall be converted into a tungsten lamp of color temperature 4000K. The gains are $G_{AR}>G_{AB}$, such that TV images with lower color temperature will contribute to create a more comfortable environment.

The gray level expanding unit 40 is aimed to avoid false contour of images arising from lower gray level after brightness gain $g_T$ operation. Given the fact of commonly designed 8-bit displays, only 256 gray levels can be presented, and brightness gain $g_T$ will reduce the gray level of images. If image gray level subjected to brightness gain operation is directly output, false contour will take place at lower gray level due to insufficient gray level. The images of gray level become more apparent in the case of lower or smaller brightness gains. For this reason, Spacial Error Diffusion or Time Dithering technology shall be applied to improve the hierarchical images of lower gray level.

The innovative method of the present invention allows automatic control of the optical flux of a LCD TV with the change of LCD images and ambient light, thus alleviating overburdening of human eyes and improving the contrast and comfort of images for a better visual effect.

FIG. 4 is another preferred embodiment of the present invention. A LED optical module 50, which comprises red, green and blue LEDs, is located nearby a LCD TV. The aforementioned ambient light detection and brightness adaptation regulating unit 30 is used to control LED optical module 50, and to automatically change the color of light source to create a better environment in the case of change of ambient light.

FIG. 5 is another preferred embodiment of the present invention. A memory unit 11 can be neglected in the image brightness regulating unit 10, while the brightness of a prior image is applied for regulation of image brightness, thereby saving the cost of a memory unit.

Furthermore, measured data is used to describe how LCD's brightness control method of the present invention controls the brightness of LCD according to brightness ratio. As illustrated in FIG. 6, the red line shows the relationship between brightness ratio and brightness output of LCD TV prior to actual measurement and regulation, the black line shows the relationship between brightness ratio and brightness output of LCD TV after actual measurement and regulation, and the blue line shows the expected relationship between brightness and presentation ratio of LCD TV after regulation.

DETAILED DESCRIPTION OF THE INVENTION

Figure 1:
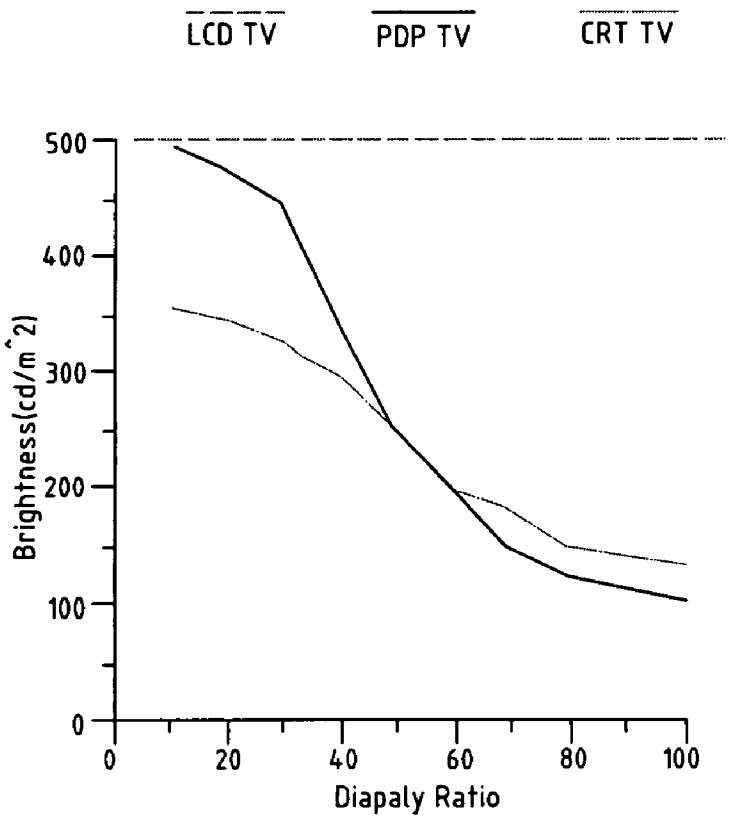
FIG.1 PRIOR ART
FIG. 1 shows a graph illustration of the brightness and brightness ratio of CRT TV.
Figure 2:
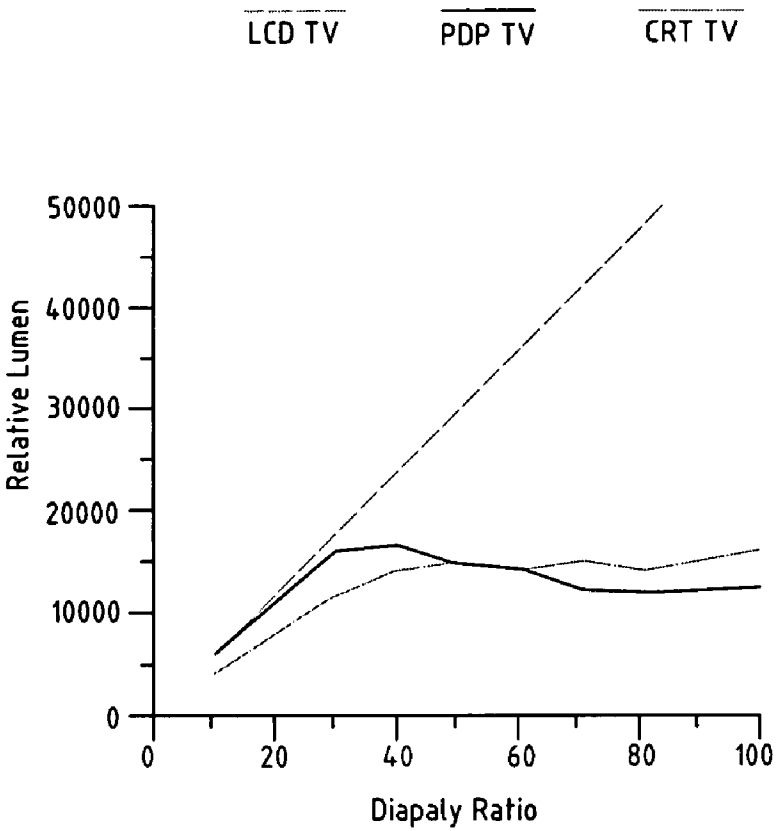
FIG.2 PRIOR ART
FIG. 2 shows a graph illustration of the brightness and brightness ratio of LCD TV.
Figure 3:
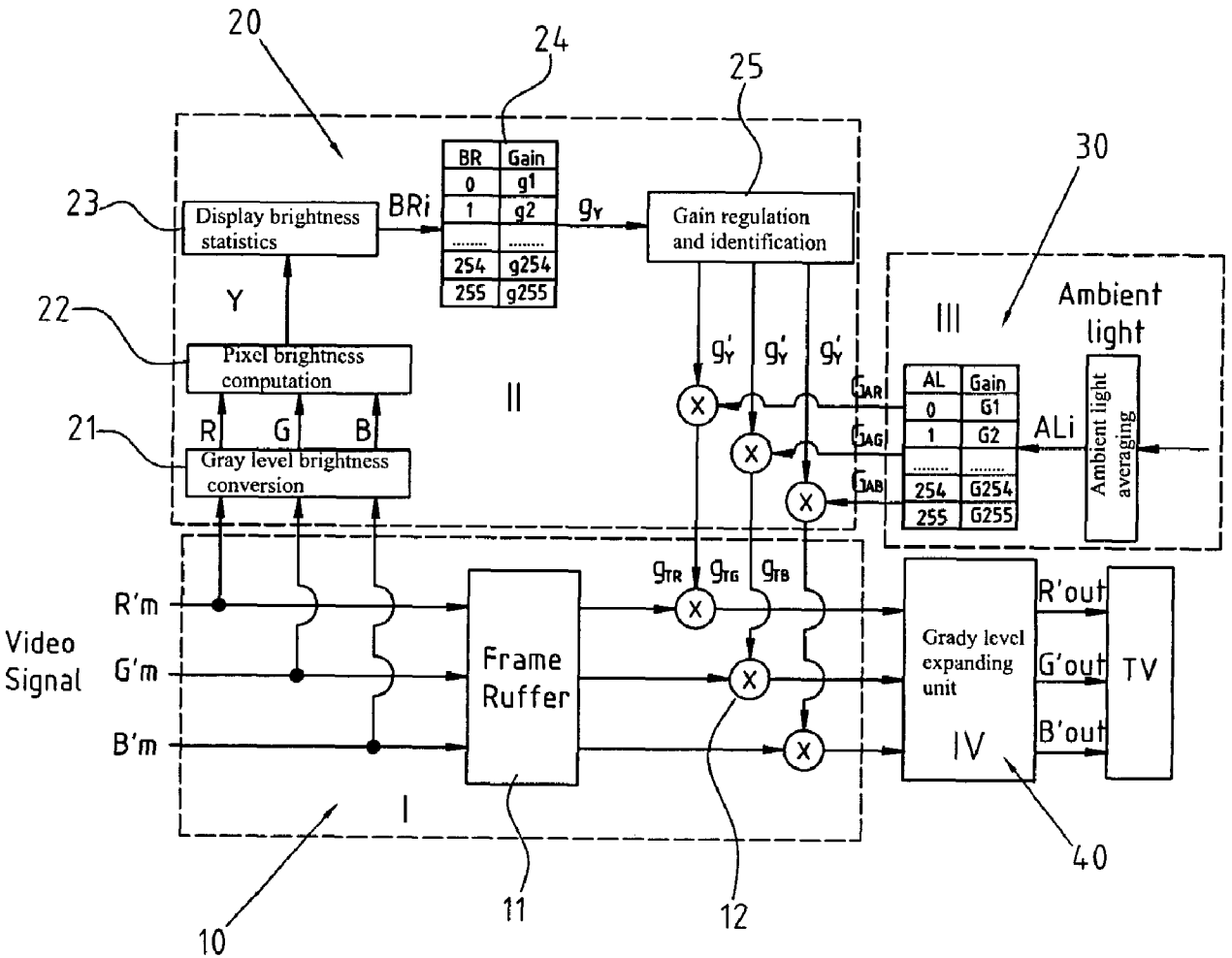
FIG. 3 shows a schematic view of a flowchart of the preferred embodiment of the present invention.
Figure 4:
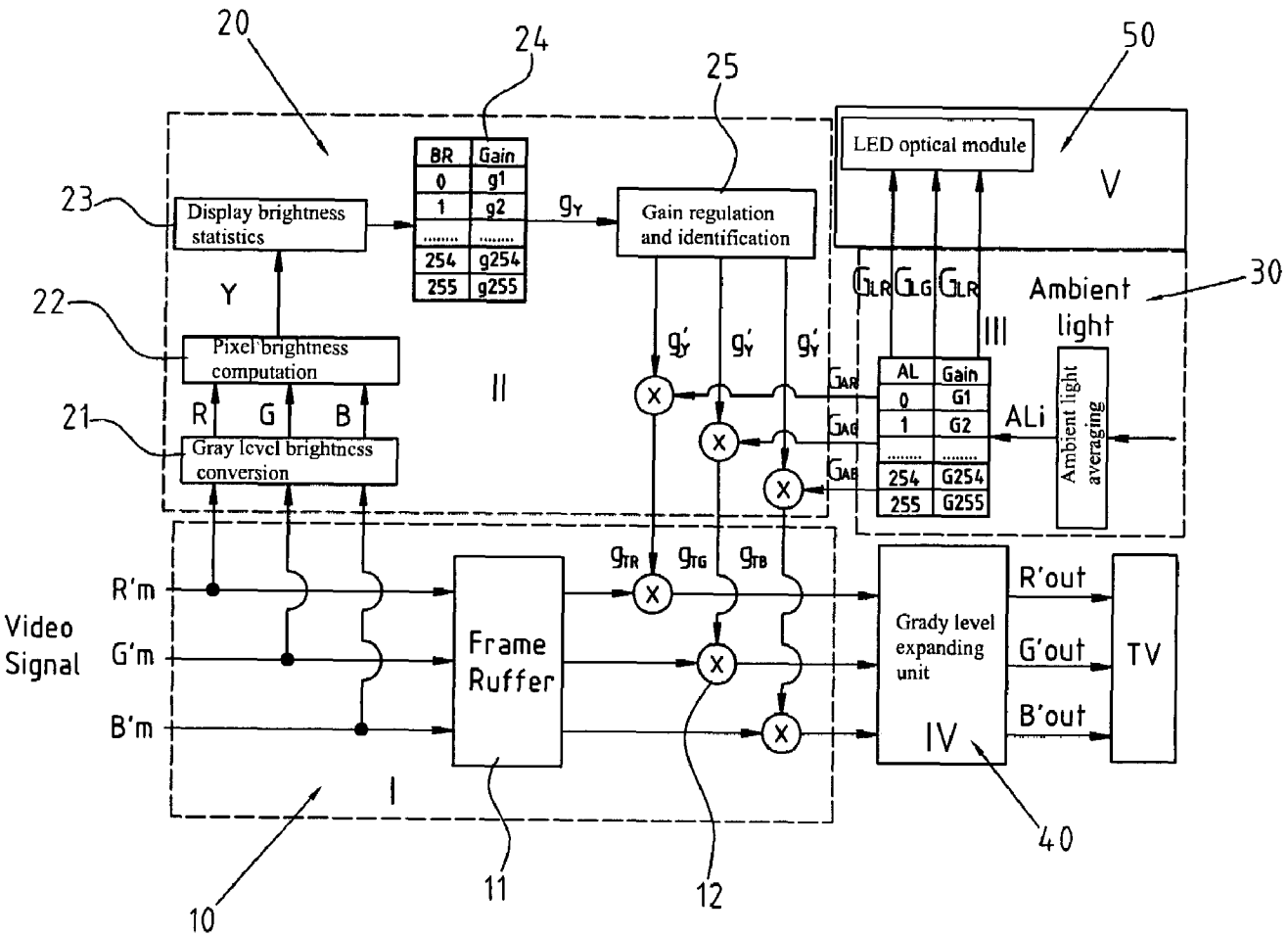
FIG. 4 shows another schematic view of a flowchart of another preferred embodiment of the present invention.
Figure 5:
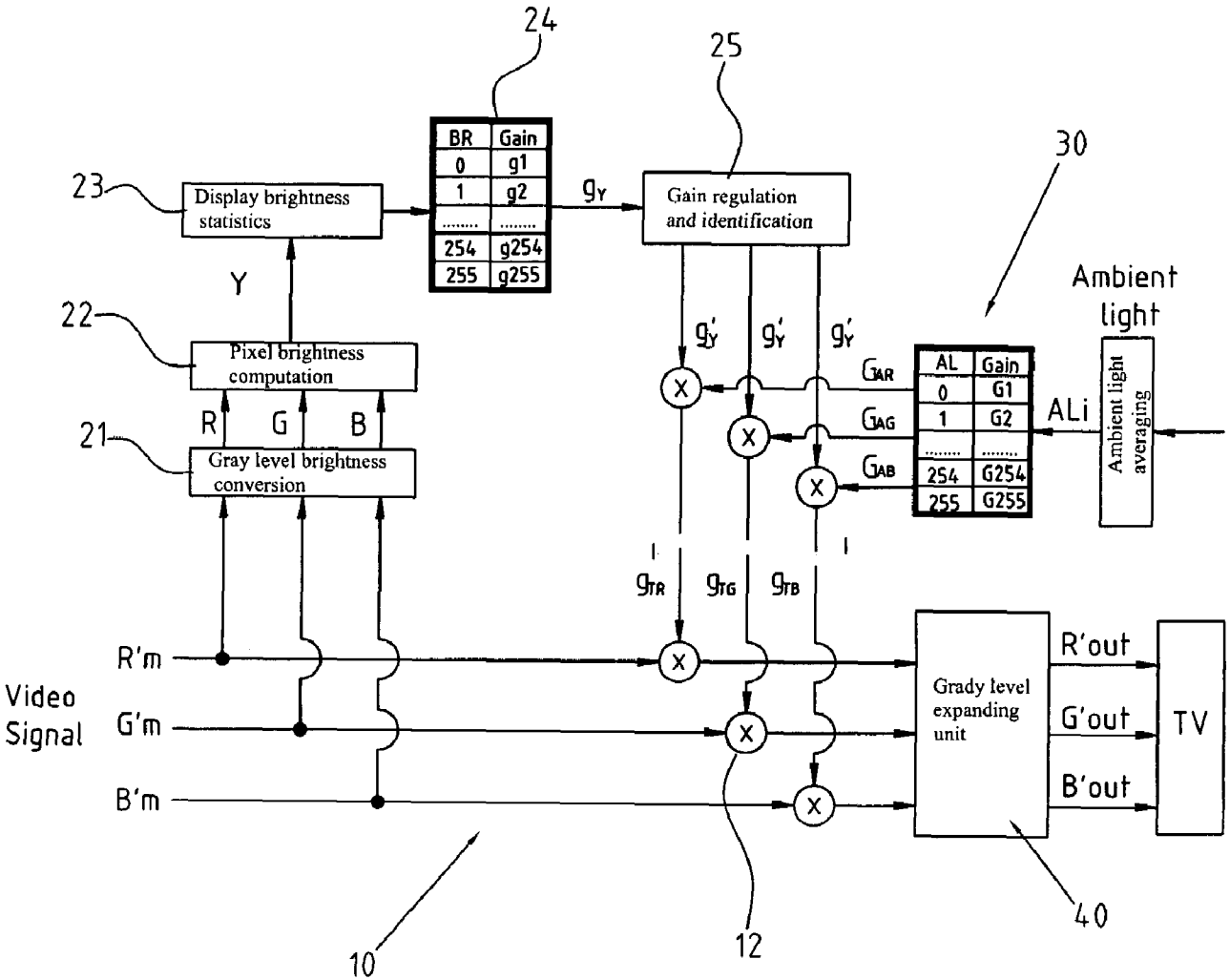
FIG. 5 shows still another schematic view of a flowchart of another preferred embodiment of the present invention.
Figure 6:
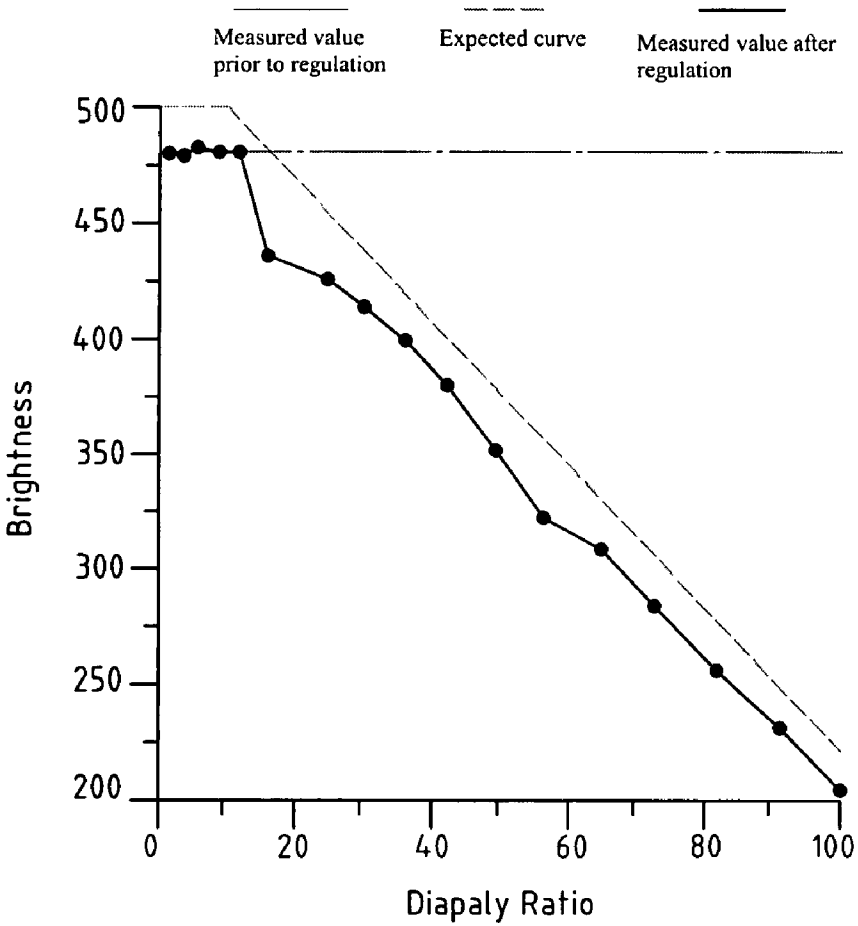
FIG. 6 shows a graph illustration of the results of LCD brightness of the present invention.

The innovative method to automatically regulate brightness of liquid crystal displays of the present invention has an integrated image brightness regulating unit 10, image brightness ratio computing and output controlling unit 20, ambient light detection and brightness adaptation regulating unit 30 and image gray level expanding unit 40. This makes it possible to automatically control the optical flux of a LCD TV with the change of LCD images and ambient light, thus alleviating overburdening of human eyes and improving the contrast and comfort of images for a better visual effect.

According to another preferred embodiment of the present invention, an innovative LED optical module 50 is located nearby a LCD TV. This module comprises red, green and blue LEDs, so the ambient light detection and brightness adaptation regulating unit can be used to control the LED optical module and to automatically change the color of light source to create a better environment in the case of change of ambient light.

A memory unit 11 can be omitted in the image brightness regulating unit 10, while the brightness of prior image is applied for regulation of image brightness, thereby saving the cost of a memory unit.

Although the invention has been explained in relation to its preferred embodiment, it is to be understood that many other possible modifications and variations can be made without departing from the spirit and scope of the invention as hereinafter claimed.

We claim:

1. A method to automatically regulate brightness of liquid crystal displays, said method comprising the steps of:

enabling a gray level of an output image to be regulated by an image brightness regulating unit, said image brightness regulating unit being comprised of a memory unit and a multiplier, based on ambient light and images, said gray level of output image being regulated in such a manner to store images in said memory unit, after completion of statistics of image brightness ratio and identification of brightness gains, said images in said memory unit being output with red, green and blue gray levels of the images multiplied by corresponding brightness gains, thereby regulating the image brightness by changing image gray level; and applying an image brightness ratio computing and output controlling unit for statistical analysis of image brightness, said image brightness ratio computing and output controlling unit comprising:

a gray level/brightness converting unit, enabling conversion between gray level and corresponding brightness of image, such that a linearity between gray level and brightness accurately calculates brightness of images;

a pixel brightness calculating unit converting red, green and blue gray levels of pixel into brightness;

a display brightness statistical unit used to calculate total brightness $Y_{image}$ and brightness ratio BR of every display, with addition of the brightness of every point in the display so as to obtain total brightness of the display, the total brightness of the display being divided by maximum total brightness $Y_{total}$ of the image, obtaining a brightness ratio of an image;

a brightness gains unit being comprised of a brightness gains table, corresponding brightness gains being checked using a brightness ratio, said brightness gains table being a relational table of brightness gains and a brightness ratio established based on a relationship between expected brightness and brightness ratio;

a gains regulation determining unit used to calculate and regulate change rate of a brightness gain, the brightness gain output by the brightness gains unit varying with a sharp change of brightness ratio, the brightness gains being output, the brightness gain varying little with slow or minor change of a brightness ratio;

an ambient light detection and brightness adaptation regulating unit, detecting the change of ambient light using an optical sensor; with a reference to LUT after low pass filtering of the change of ambient light, and determining the brightness gain of ambient light, the sensor of ambient light being available in monocolor or multicolor type, for a multicolor light sensor, the gains being properly regulated with color change of ambient light; and a gray level expanding unit aimed to avoid false contour of images arising from lower gray level after brightness gain operation, applying spacial error diffusion or time dithering technology to improve the hierarchical images of the lower gray level.

2. The method defined in claim 1, further comprising:

a pixel brightness calculating unit of said image brightness ratio computing and output controlling unit, controlling the brightness using color space of perceptual uniformity.

3. The method defined in claim 1, further comprising:

enabling smoothing by gain regulation determining unit of the change of brightness gains, said output brightness gain being a mean value of brightness gain output by N (positive integral) images and current brightness gain, when the brightness gain of a neighboring image has a change rate lower than a threshold.

4. The method defined in claim 1, further comprising:

omitting said memory unit of said image brightness regulating unit, regulating the image brightness via brightness of prior image.

5. A method to automatically regulate brightness of liquid crystal displays, said method comprising the steps of:

enabling a gray level of an output image to be regulated by an image brightness regulating unit, said image brightness regulating unit being comprised of a memory unit and a multiplier, based on ambient light and images, said gray level of output image being regulated in such a manner to store images in said memory unit, after completion of statistics of image brightness ratio and identification of brightness gains, said images in said memory unit being output with red, green and blue gray levels of the images multiplied by corresponding brightness gains, thereby regulating the image brightness by changing image gray level;

applying an image brightness ratio computing and output controlling unit for statistical analysis of image brightness, said image brightness ratio computing and output controlling unit comprising:

a gray level/brightness converting unit, enabling conversion between gray level and corresponding brightness of image, such that a linearity between gray level and brightness accurately calculates brightness of images;

a pixel brightness calculating unit converting red, green and blue gray levels of pixel into brightness;

a display brightness statistical unit used to calculate total brightness $Y_{image}$ and brightness ratio BR of every display, with addition of the brightness of every point in the display so as to obtain total brightness of the display, the total brightness of the display being divided by maximum total brightness $Y_{total}$ of the image, obtaining a brightness ratio of an image;

a brightness gains unit being comprised of a brightness gains table, corresponding brightness gains being checked using a brightness ratio, said brightness gains table being a relational table of brightness gains and a brightness ratio established based on a relationship between expected brightness and brightness ratio; and a gains regulation determining unit used to calculate and regulate change rate of a brightness gain, the brightness gain output by the brightness gains unit varying with a sharp change of brightness ratio, the brightness gains being output, the brightness gain varying little with slow or minor change of a brightness ratio;

detecting the change of ambient light by an ambient light detection and brightness adaptation regulating unit, using an optical sensor, with a reference to LUT after low pass filtering of the change of ambient light, and determining the brightness gain of ambient light, the sensor of ambient light being available in monocolor or multicolor type, for a multicolor light sensor, the gains being properly regulated with color change of ambient light;

applying spacial error diffusion or time dithering technology to improve the hierarchical images of the lower gray level by a gray level expanding unit aimed to avoid false contour of images arising from lower gray level after brightness gain operation; and automatically changing color of the light source in case of color change of ambient light by a LED optical module is located nearby LCD TV, the module being comprised of red, green and blue LEDs, so a ambient light detection and brightness adaptation regulating unit can be used to control LED optical module.

6. The method defined in claim 5, further comprising:

a pixel brightness calculating unit of said image brightness ratio computing and output controlling unit, controlling the brightness using color space of perceptual uniformity.

7. The method defined in claim 5, further comprising:

enabling smoothing by gain regulation determining unit of the change of brightness gains, said output brightness gain being a mean value of brightness gain output by N (positive integral) images and current brightness gain, when the brightness gain of a neighboring image has a change rate lower than a threshold.

8. The method defined in claim 5, further comprising:

omitting said memory unit of said image brightness regulating unit, regulating the image brightness via brightness of prior image.

* * * * *